US006859175B2

(12) United States Patent
Desclos et al.

(10) Patent No.: US 6,859,175 B2
(45) Date of Patent: Feb. 22, 2005

(54) MULTIPLE FREQUENCY ANTENNAS WITH REDUCED SPACE AND RELATIVE ASSEMBLY

(75) Inventors: Laurent Desclos, San Diego, CA (US); Gregory Poilasne, San Diego, CA (US); Sebastian Rowson, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 41 days.

(21) Appl. No.: 10/309,484

(22) Filed: Dec. 3, 2002

(65) Prior Publication Data

US 2004/0104848 A1 Jun. 3, 2004

(51) Int. Cl.[7] ..... H01Q 1/38
(52) U.S. Cl. ..... 343/700 MS; 343/767
(58) Field of Search ..... 343/700 MS, 702, 343/829, 846, 767, 770

(56) References Cited

U.S. PATENT DOCUMENTS

| | | | | |
|---|---|---|---|---|
| 3,827,053 A | | 7/1974 | Willie et al. | |
| 4,450,449 A | | 5/1984 | Jewitt | |
| 4,598,276 A | | 7/1986 | Tait | |
| 4,749,996 A | | 6/1988 | Tresselt | |
| 5,087,922 A | | 2/1992 | Tang et al. | |
| 5,241,321 A | * | 8/1993 | Tsao | 343/700 MS |
| 5,245,745 A | | 9/1993 | Jensen et al. | |
| 5,309,164 A | | 5/1994 | Dienes et al. | |
| 5,410,323 A | | 4/1995 | Kuroda | |
| 5,764,190 A | | 6/1998 | Murch et al. | |
| 5,835,063 A | | 11/1998 | Brachat et al. | |
| 5,936,583 A | | 8/1999 | Sekine et al. | |
| 5,936,590 A | | 8/1999 | Funder | |
| 5,966,096 A | | 10/1999 | Brachat | |
| 5,986,606 A | | 11/1999 | Kossiavas et al. | |
| 6,002,367 A | | 12/1999 | Engblom et al. | |
| 6,008,764 A | | 12/1999 | Ollikainen et al. | |
| 6,046,707 A | | 4/2000 | Gaughan et al. | |
| 6,054,954 A | * | 4/2000 | Eggleston et al. | 343/700 MS |
| 6,140,965 A | | 10/2000 | Van Hoozen | |
| 6,140,969 A | | 10/2000 | Lindenmeier et al. | |
| 6,147,649 A | | 11/2000 | Irvissimtzis et al. | |
| 6,157,348 A | | 12/2000 | Openlander | |
| 6,181,281 B1 | | 1/2001 | Desclos et al. | |
| 6,211,825 B1 | | 4/2001 | Deng | |

(List continued on next page.)

FOREIGN PATENT DOCUMENTS

| | | |
|---|---|---|
| EP | 0 604 338 A | 6/1994 |
| EP | 0 942 488 A | 9/1999 |
| EP | 1 067 627 A | 1/2001 |
| JP | 56 012102 | 2/1981 |
| JP | 09 055621 A | 2/1997 |
| JP | 2000 031735 A | 1/2000 |
| JP | 2000 068736 A | 3/2000 |

OTHER PUBLICATIONS

Wheeler, "Small Antennas." IEEE Transactions on Antennas and Propagation, 462–468, Jul. 1975.

(List continued on next page.)

*Primary Examiner*—Tho Phan
(74) *Attorney, Agent, or Firm*—Foley & Lardner LLP

(57) ABSTRACT

The disclosed embodiments of the present invention include an antenna element having a generally low profile and providing a larger bandwidth. The disclosed embodiments include antenna elements having a top section with at least one cutout. Each cutout is provided with one or more tongues therein. The tongues extend from an edge of the cutout inward. The tongues may be coplanar with the top section or may be positioned between the top section and a bottom plate. Each tongue may be positioned separately to produce the desired antenna element characteristics.

13 Claims, 9 Drawing Sheets

U.S. PATENT DOCUMENTS

| | | | | | |
|---|---|---|---|---|---|
| 6,246,371 | B1 | | 6/2001 | Kurz et al. | |
| 6,323,810 | B1 | * | 11/2001 | Poilasne et al. | 343/700 MS |
| 6,339,409 | B1 | | 1/2002 | Warnagiris | |
| 6,362,789 | B1 | | 3/2002 | Trumbull et al. | |
| 6,369,777 | B1 | | 4/2002 | Ohara et al. | |
| 6,373,442 | B1 | * | 4/2002 | Thomas et al. | 343/767 |
| 6,417,807 | B1 | | 7/2002 | Hsu et al. | |
| 6,529,749 | B1 | | 3/2003 | Hayes et al. | |
| 6,573,869 | B2 | * | 6/2003 | Moore | 343/702 |
| 2003/0201943 | A1 | * | 10/2003 | Kadambi et al. | 343/702 |

OTHER PUBLICATIONS

Sievenpiper et al., "High impedance electromagnetic surfaces with a forbidden frequency band." IEEE Transactions on Microwave Theory and Techniques, 47(11): 2059–2074, 1999.

International Search Report from PCT Application No. PCT/US02/20242.

International Search Report for international application PCT/US03/37031.

* cited by examiner

MULTIPLE FREQUENCY ANTENNAS WITH REDUCED SPACE AND RELATIVE ASSEMBLY

CROSS-REFERENCE TO RELATED APPLICATIONS

This application relates to co-pending application Ser. No. 09/892,928, filed on Jun. 26, 2001, entitled "Multi Frequency Magnetic Dipole Antenna Structures and Method of Reusing the Volume of an Antenna," by L. Desclos et al., owned by the assignee of this application and incorporated herein by reference.

This application relates to co-pending application Ser. No. 10/076922, filed on Feb. 8, 2002, entitled "Multi Frequency Magnetic Dipole Antenna Structures for Very Low-Profile Antenna Applications," by G. Poilasne et al., owned by the assignee of this application and incorporated herein by reference.

This application relates to co-pending application Ser. No. 10/133,717, filed on Apr. 25, 2002, entitled "Low-Profile, Multi-Frequency, Multi-Band, Capacitively Loaded Magnetic Dipole Antenna," by G. Poilasne et al., owned by the assignee of this application and incorporated herein by reference.

BACKGROUND INFORMATION

1. Field of the Invention

The present invention relates generally to the field of wireless communications, and particularly to the magnetic dipole antennas.

2. Background

The information contained in this section relates to the background of the art of the present invention without any admission as to whether or not it legally constitutes prior art.

Certain wireless communication applications such as the Global System for Mobile Communications (GSM) and Personal Communications Service (PCS) require that multiple bands be accessible, depending upon the local frequency coverage available from a service provider. Because applications such as GSM and PCS are used in the context of wireless communications devices that have relatively small form-factors, an antenna should generally have a low profile.

Further, many wireless applications require a relatively large bandwidth. In order to achieve this large bandwidth, many wireless devices are required to employ either a large antenna element or multiple antenna elements. This solution is not practical for wireless devices which require the antenna to be accommodated in a relatively small package, thus requiring that the antenna have a low profile.

The present invention addresses the requirements of certain wireless communications applications by providing low-profile antennas that may provide a larger bandwidth.

SUMMARY OF THE INVENTION

The disclosed embodiments of the present invention include an antenna element having a generally low profile and providing a larger bandwidth. The disclosed embodiments include antenna elements having a top section with at least one cutout. Each cutout is provided with one or more tongues therein. The tongues extend from an edge of the cutout inward. The tongues may be coplanar with the top section or may be positioned between the top section and a bottom plate. Each tongue may be positioned separately to produce the desired antenna element characteristics.

This summary does not purport to define the invention. The invention is defined by the claims.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

A capacitively loaded, magnetic dipole (CLMD) antenna produces a specific frequency, band of frequency, or combination therein for targeted applications like GSM and PCS. The resonant frequency is a result of the inductance and capacitance components. CLMD antennas present various advantages, chief among them is excellent isolation. In order to provide greater bandwidth, the confinement of the antenna may be relaxed. The various embodiments described below effectively relax the confinement of the antenna.

Figure 1A:
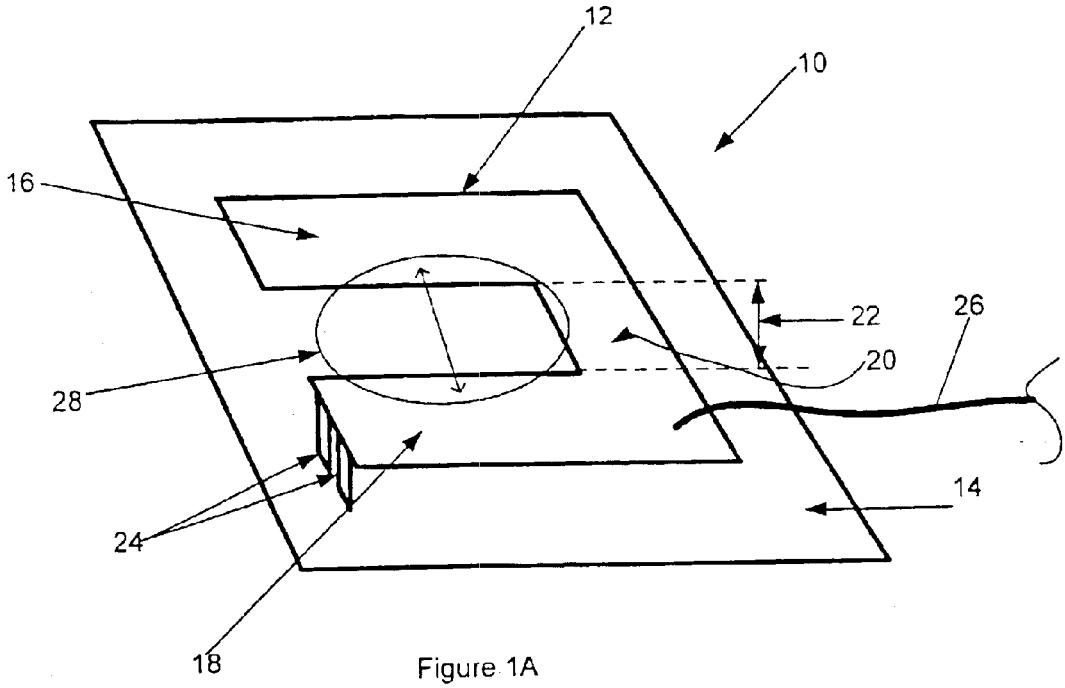
FIG. 1A illustrates a three-dimensional view of one embodiment of an antenna element for use, for example, in wireless devices.
Figure 1B:
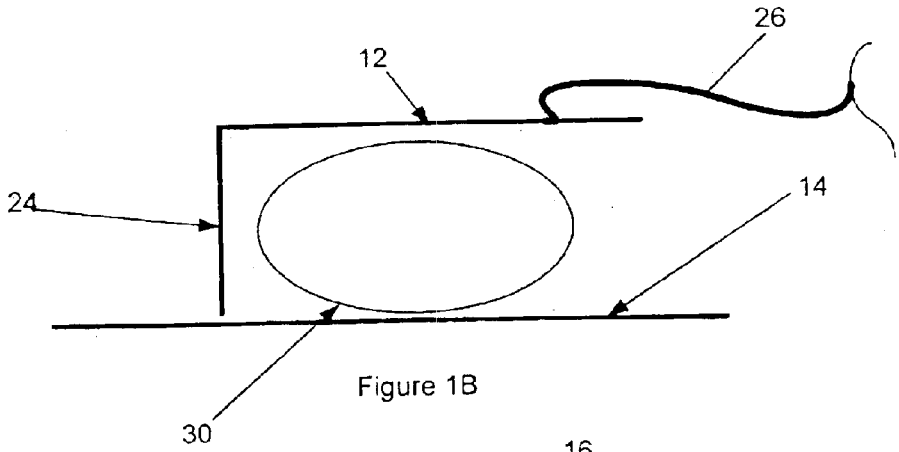
FIG. 1B illustrates a side-view of the antenna element of FIG. 1A.
Figure 1C:
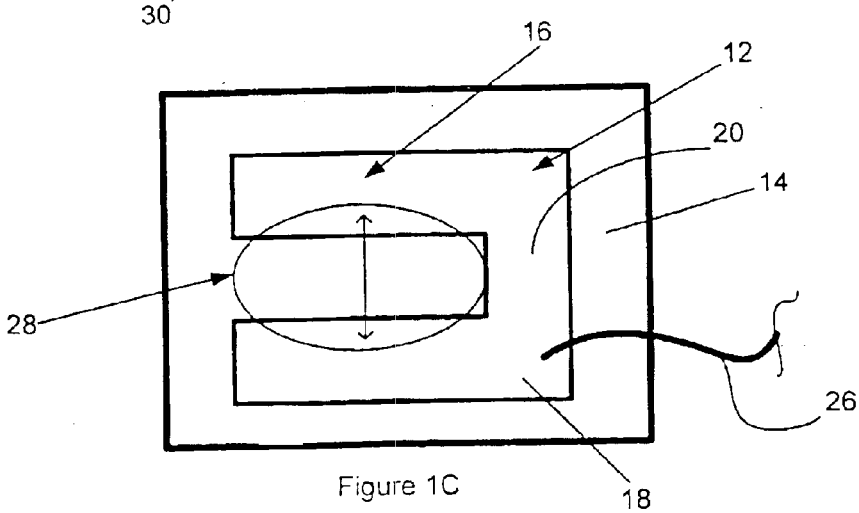
FIG. 1C illustrates a top-view of the antenna element of FIGS. 1A and 1B.

FIGS. 1A–1C illustrate one embodiment of a single CLMD antenna element 10. The antenna element 10 includes a top section 12 and a bottom plate 14. The top section 12 is cut to include two top plates 16, 18 and a connection section 20 connecting the two top plates 16, 1S. The two top plates 16, 18 are substantially coplanar and are separated by a gap 22.

The top section 12 is separated from the bottom plate 14 by a distance which may be varied to achieve desired antenna element characteristics. Feeding points 24 provide the necessary separation between the top section 12 and the bottom plate 14. A feed line 26 is adapted to provide electrical charge to the top section 12.

The two top plates 16, 18 comprise a capacitance component 28 (FIGS. 1A and 1C) of the antenna element 10. A loop between the two top plates 16, 18 and the bottom plate 14 comprises an inductance component 30 (FIG. 1B) of the antenna element 10.

One way to further relax the confinement of the antenna 10 is to increase the gap 22 between the two top plates 16, 18. At a certain point, the capacitance component 28 of the antenna element 10 becomes too small to keep a low frequency due to the increased gap 22 between the two top plates 16, 18. The reduction in capacitance is compensated by an increase in the inductance obtained from the connection section 20 of the top section 12.

The bandwidth obtained by a relaxed CLMD antenna element of the type illustrated in FIGS. 1A–1C may have to be further increased for certain applications. In this case, the bandwidth may be improved by adding a bridge over the gap between the two top plates. The bridge may be used to provide a second frequency band for the antenna element. FIG. 2A illustrates a top-view of an embodiment of a CLMD antenna element using such a bridge. The antenna element 32 includes a top section 34 and a bottom plate 36. The top section 34 includes two top plates 38, 40 separated by a gap. The two top plates 38, 40 comprise a capacitance component 41 of the antenna element 32. The antenna element 32 is also provided with a bridge 42 overlaying at least part of the gap between the two top plates 38, 40. The bridge 42 provides the antenna element 32 with a wider bandwidth.

Figure 2B:
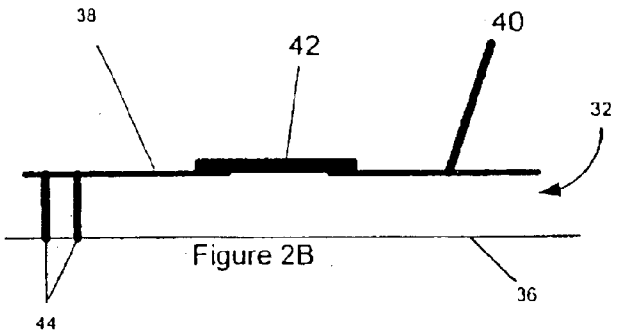
FIGS. 2B–2D illustrate side-views of various configurations of the antenna element of FIG. 2A.
Figure 2C:
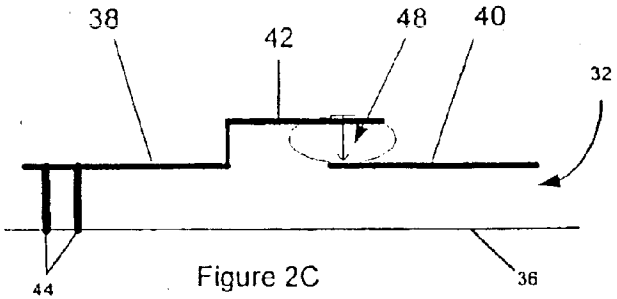
Figure 2D:
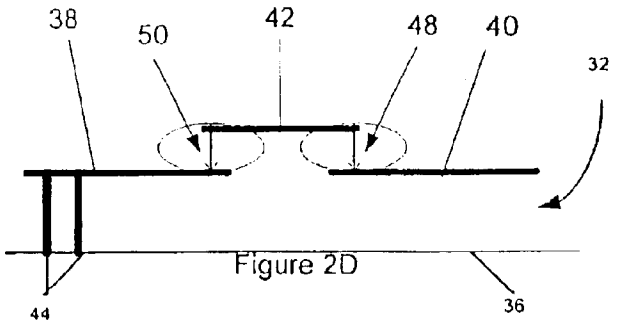
Figure 2A:
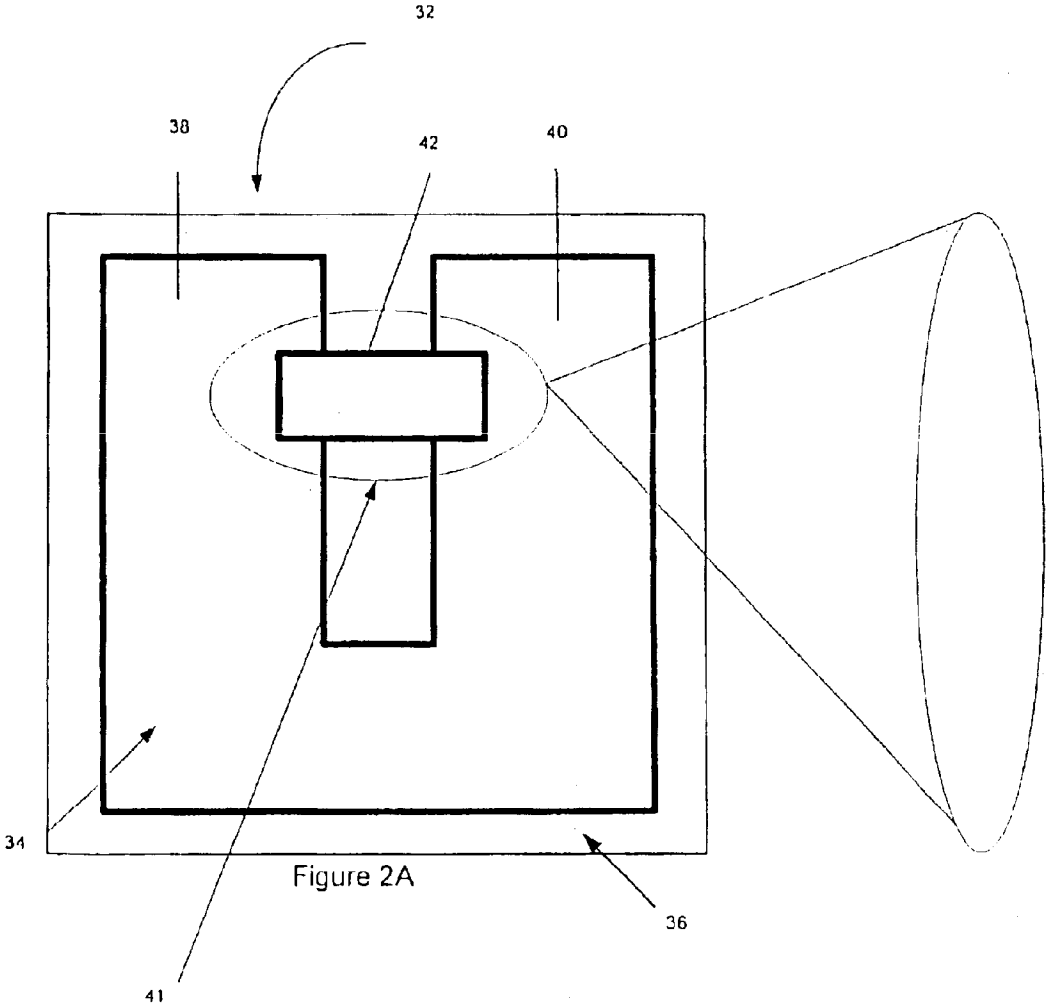
FIG. 2A illustrates a top-view of another embodiment of an antenna element for use, for example, in wireless devices.

FIGS. 2B–2D illustrate side-views of various configuration of the antenna element 32 of FIG. 2A. In the illustrated embodiments, feeding points 44 provide a gap between the top section 34 and the bottom plate 36. In the embodiment illustrated in FIG. 2B, the bridge 42 is electrically connected to both top plates 38, 40. In another embodiment, illustrated in FIG. 2C, the bridge is electrically connected to one top plate 38 and capacitively loaded on the other top plate 40, forming a capacitance component 48. In yet another embodiment, illustrated in FIG. 2D, the bridge is capacitively loaded on both top plates 38, 40, forming capacitance components 48, 50. In the embodiments illustrated in FIGS. 2C and 2D, adjustment of the vertical distance between the bridge 42 and a top plate 38, 40 will tune the frequency of the antenna element 32. In the embodiment illustrated in FIG. 2D, a spacer or insert (not shown) may be used to maintain the placement of the bridge relative to the top plates.

Figure 3A:
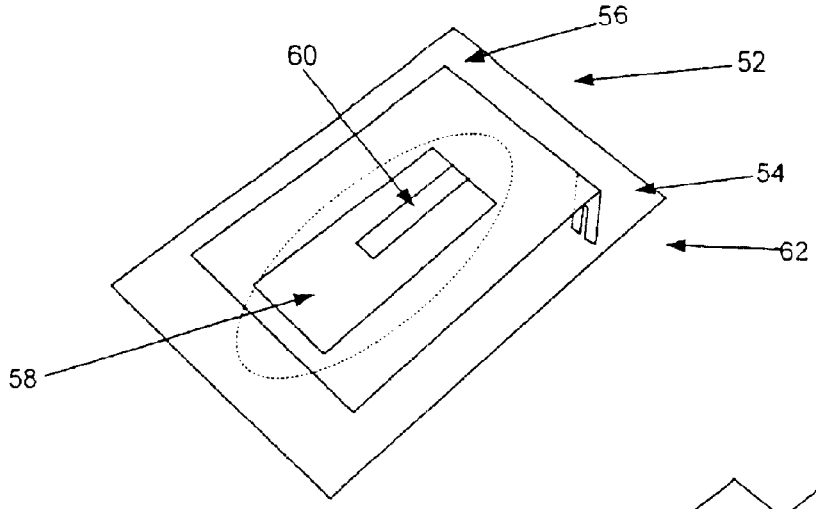
FIG. 3A illustrates a three-dimensional view of an embodiment of an antenna element in accordance with the present invention.

FIG. 3A illustrates a three-dimensional view of an embodiment of an antenna element in accordance with the present invention. In this illustration, an antenna element 52 having a bottom plate 54 and a top section 56 is provided with a cutout 58 in a central region of the top section 56. The cutout 58 in the embodiment illustrated in FIG. 3A is of a rectangular configuration. However, it will be understood by those skilled in the art that other configurations are possible.

A tongue 60 extends from one edge of the cutout 58 into the cutout 58. The tongue 60 may be integrally formed with the top section 56. As with the cutout 58, although the tongue 60 in the illustrated embodiment has a rectangular configuration, other configurations are also contemplated. In the illustrated embodiment, the tongue 60 extends from the edge of the cutout 58 nearest feeding points 62 connecting the top section 56 to the bottom plate 54. The position, shape, and size of the tongue may be selected to tune the antenna element 52to meet the frequency requirements of a targeted application. In the illustrated embodiment, the top section 56 and the tongue 60 are coplanar.

Figure 3B:
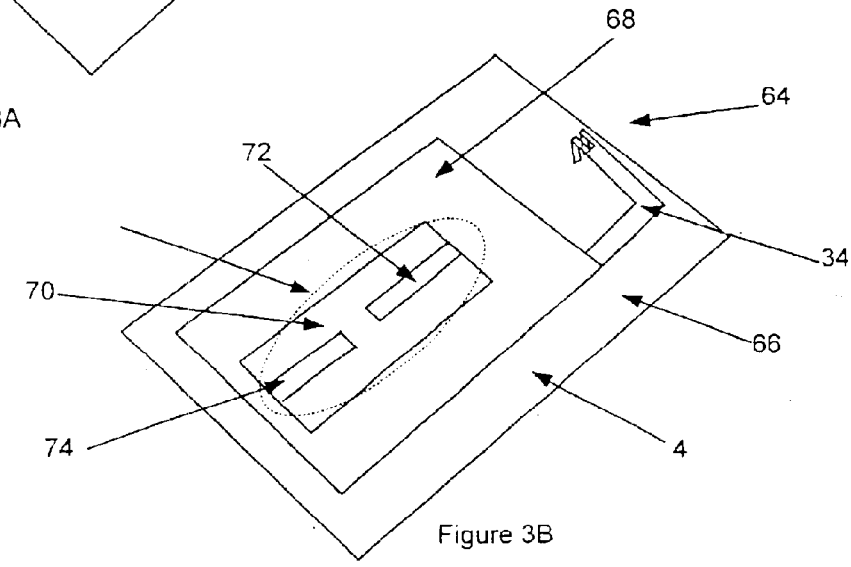
FIG. 3B illustrates a three-dimensional view of another embodiment of an antenna element in accordance with the present invention.

FIG. 3B illustrates a three-dimensional view of another embodiment of an antenna element in accordance with the present invention. The antenna element 64 illustrated in FIG. 3B is similar to the antenna element 52 illustrated in FIG. 3A, having a bottom plate 66 and a top section 68 with a central cutout 70. In this embodiment illustrated in FIG. 3B, the cutout 70 in the top section 68 is provided with two tongues 72, 74 extending from opposite edges of the cutout 70. The two tongues 72, 74 act with the ground plate 66 as a capacitance component of the antenna element 64. The position, shape, and size of the tongues may be adjusted to tune the antenna to meet the frequency requirements of the targeted application. Further, although the tongues 72, 74 illustrated in FIG. 3B are substantially identical, mirror-images, other embodiments may include two tongues 72, 74 that are dissimilar in shape, size or other characteristics. Although the embodiment illustrated in FIG. 3B includes two tongues 72, 74 in the cutout 70, any practical number of tongues may be provided within a cutout. The number of tongues may be selected to achieve the desired characteristics of the antenna element 64.

Figure 3C:
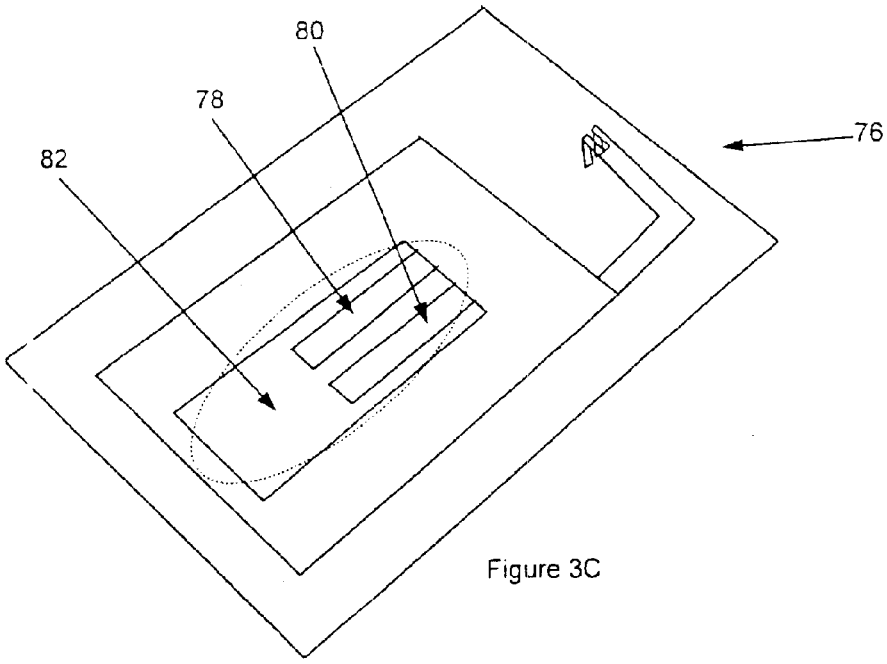
FIG. 3C illustrates a three-dimensional view of another embodiment of an antenna element in accordance with the present invention.

While the antenna element 64 illustrated in FIG. 3B includes two tongues 72, 74 extending from opposite edges, other configurations are also possible. For example, FIG. 3C illustrates a three-dimensional view of an embodiment of an antenna element 76 in accordance with the present invention having two tongues 78, 80 in a cutout 82 in a top section 84, with both tongues 78, 80 extending from the same edge of the cutout 82.

Figure 4A:
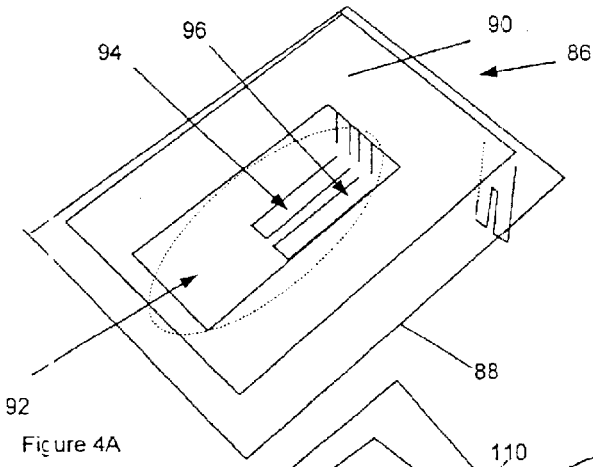
FIG. 4A illustrates a three-dimensional view of yet another embodiment of an antenna element in accordance with the present invention.
Figure 4B:
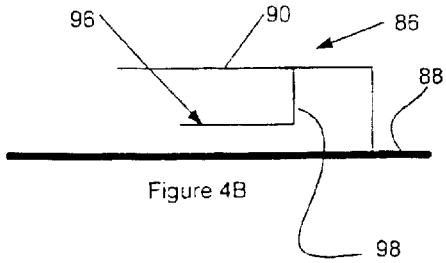
FIG. 4B illustrates a side-view of the antenna element of FIG. 4A.

FIGS. 4A and 4B illustrate another embodiment of an antenna element in accordance with the present invention. In this embodiment, the antenna element 86 is similar to the antenna element described above with reference to FIG. 3C, having a bottom plate 88, a top section 90 with a central cutout 92. In the embodiment illustrated in FIGS. 4A and 4B, two tongues 94, 96 are provided in the cutout 92 with the tongues 94, 96 being positioned out of the plane of the top section 90. As most clearly illustrated in FIG. 4B, each tongue, such as tongue 96 is still attached to the top section 90 of the antenna element 86 and is positioned between the top section 90 and the bottom plate 88 with a vertical extension 98. In the embodiment illustrated in FIGS. 4A and 4B, the vertical extension 98 projects downward substantially perpendicular to the plane of the top section 90. In other embodiments, the vertical extension 98 may project at slanted angles, for example. Although the two tongues 94, 96 are illustrated in FIGS. 4A and 4B as being coplanar with respect to each other, other embodiments may include tongues in different horizontal planes.

Figure 4C:
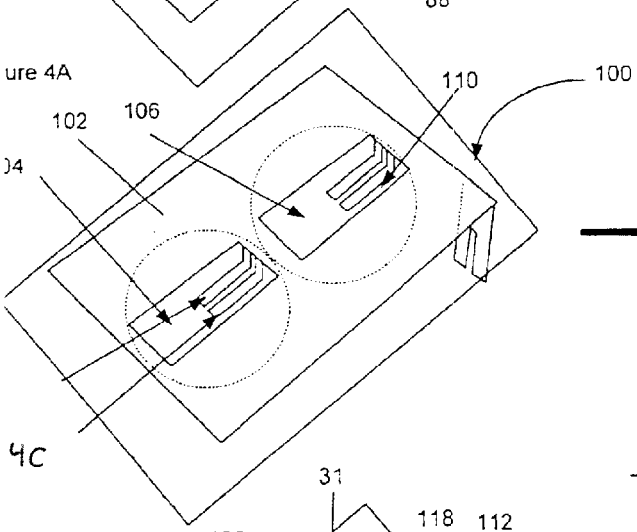
FIG. 4C illustrates a three-dimensional view of another embodiment of an antenna element in accordance with the present invention.
Figure 4D:
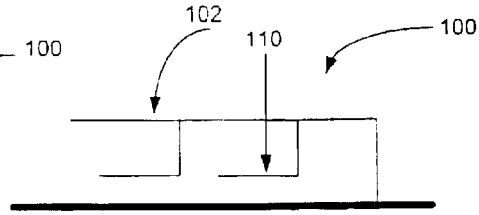
FIG. 4D illustrates a side-view of the antenna of FIG. 4C.

FIGS. 4C and 4D illustrate another embodiment of an antenna element in accordance with the present invention. The illustrated antenna element 100 includes a top section 102 with two cutouts 104, 106 in a central region of the top section 102. In the embodiment illustrated in FIGS. 4C and 4D, the two cutouts 104, 106 are arranged in an aligned configuration along a longitudinal axis. In other embodiments, cutouts may be aligned along other axes or may be position in a non-aligned manner. Further, although the illustrated embodiment includes two cutouts in the top section 102, any practical number of cutouts may be provided. The number of cutouts may be selected to provide the desired antenna element characteristics.

Referring again to FIGS. 4C and 4D, each cutout 104, 106 is provided with two tongues, such as tongues 108, 110 in cutout 106. As most clearly illustrated in FIG. 4D, the tongues are positioned in a coplanar configuration relative to each other in a plane below the plane of the top section 102. As noted above, the tongues are not required to be coplanar with respect to other tongues.

Figure 4F:
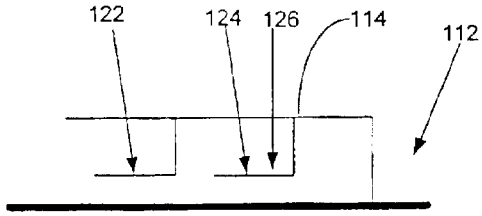
FIG. 4F illustrates a side-view of the antenna element of FIG. 4E.
Figure 4E:
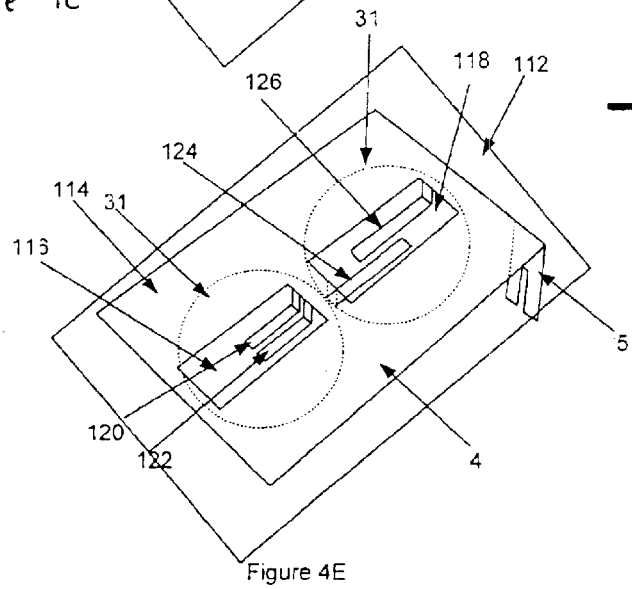
FIG. 4E illustrates a three-dimensional view of another embodiment of an antenna element in accordance with the present invention.

FIGS. 4E and 4F illustrate another embodiment of an antenna element in accordance with the present invention. The illustrated antenna element 112 includes a top section 114 having two cutouts 116, 118. The cutout 116 is provided with two tongues 120, 122 arranged in a manner similar to tongues 94, 96 of the antenna element 86 described above with reference to FIG. 4A. On the other hand, the cutout 118 is provided with two tongues 124, 126 extending from opposing edges of the cutout 118. The tongues 124, 126 are positioned so that a portion of the tongues in a center portion of the cutout 118 are in a side-by-side configuration.

Figure 5A:
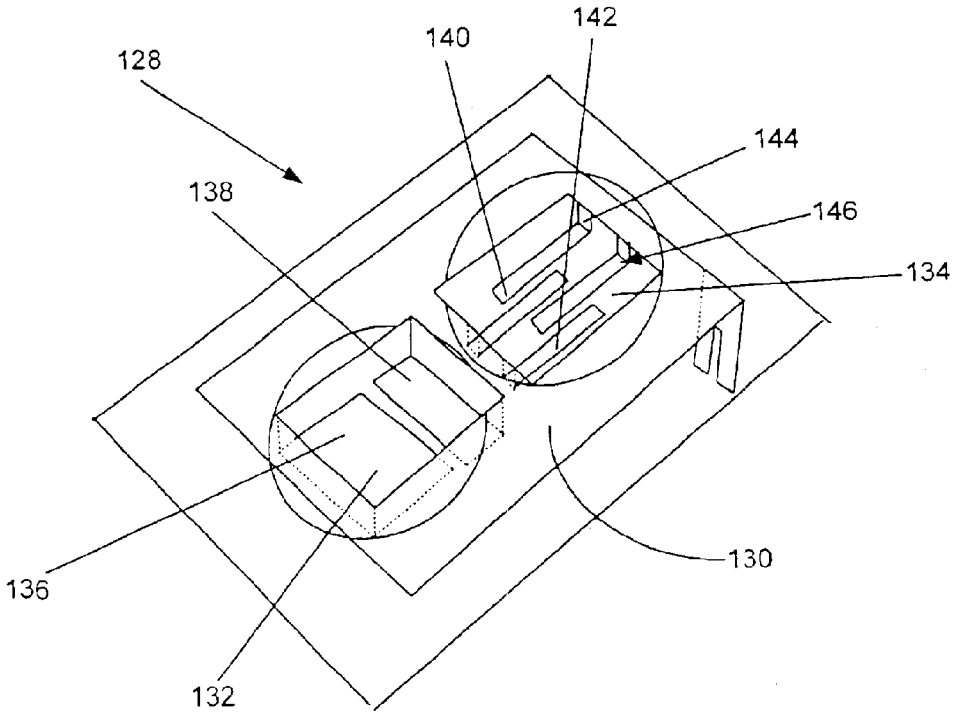
FIG. 5A illustrates a three-dimensional view of yet another embodiment of an antenna element in accordance with the present invention.
Figure 5B:
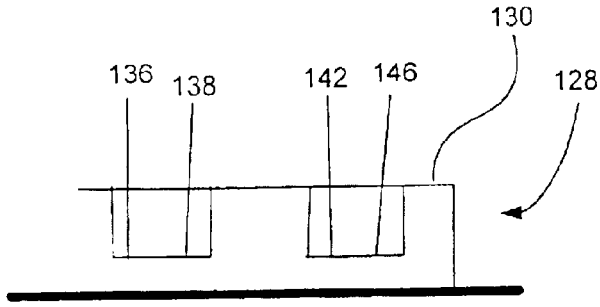
FIG. 5B illustrates a side-view of the antenna element of FIG. 5A.

FIGS. 5A and 5B illustrate another embodiment of an antenna element in accordance with the present invention. In this illustration, an antenna element 128 is provided with a top section 130 having two cutouts 132, 134. The first cutout 132 is provided with a pair of tongues 136, 138 extending from opposing edges of the cutout 132. In the illustrated embodiment, the tongues 136, 138 are flaps having a width substantially equal to the width of the cutout 132. The length of the tongues 136, 138 may be different from each other, as illustrated in FIGS. 5A and 5B. The second cutout 134 is provided with four tongues 140, 142, 144, 146 alternatingly extending from opposing edges of the cutout 134. The embodiment illustrated in FIGS. 5A and 5B includes a total of six tongues, all of which are coplanar relative to each other, but in a different plane from the plane of the top section 130. In other embodiments, the tongues may be in different planes from each other, and one or more tongues may be in the same plane as the top section.

Figure 6:
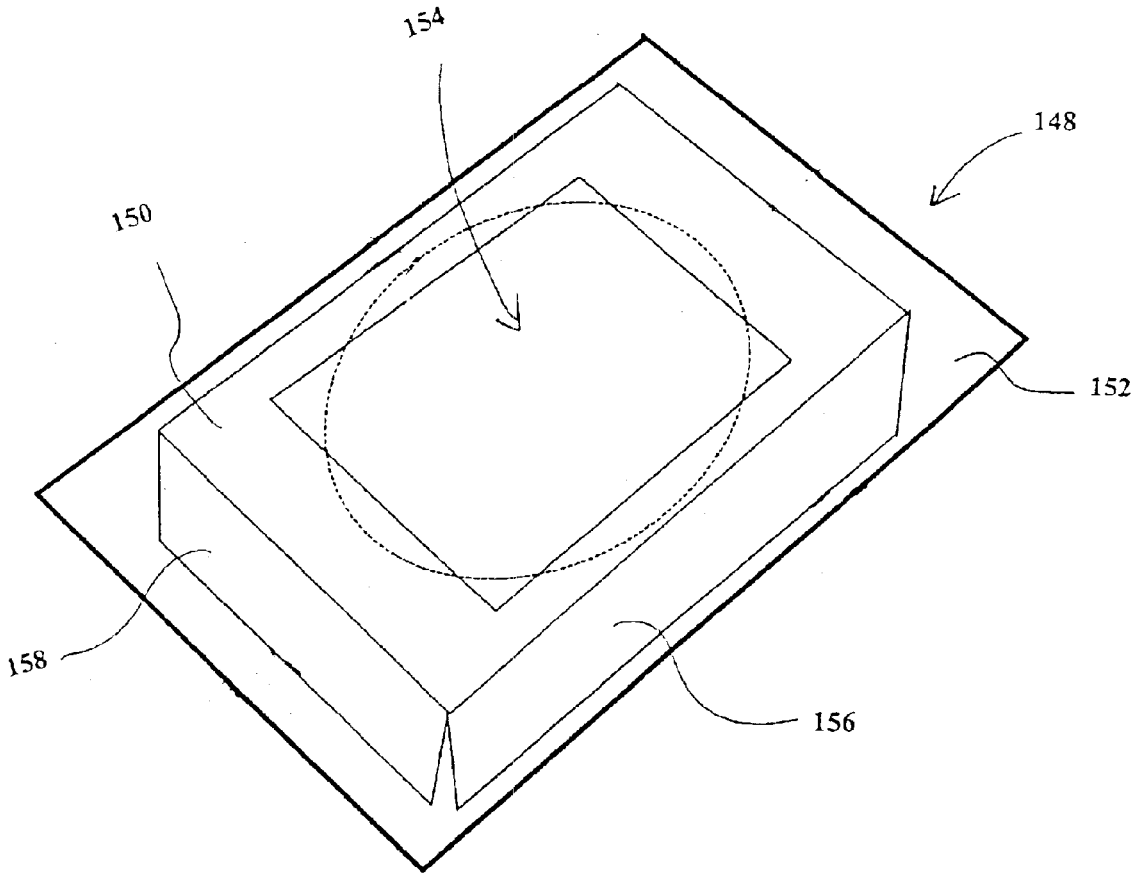
FIG. 6 illustrates a three-dimensional view of another embodiment of an antenna in accordance with the present invention.

FIG. 6 illustrates a three dimensional view of another embodiment of an antenna element in accordance with the present invention. The illustrated antenna element 148 includes a top section 150 positioned above a bottom plate 152. The top section 150 is provided with a cutout 154 in a central region of the top section 150. The cutout 150 may be sized to accommodate an insert or a module (not shown) adapted to provide the desired antenna element characteristics. The insert or module may, as described below, include tongues similar to those described above. In this manner, a modular configuration may be achieved to facilitate interchangeability of components. Although the cutout 154 embodiment illustrated in FIG. 6 is positioned in a central region of the top section 150, other embodiments may include a cutout Located on an edge of the top section, for example.

In the illustrated embodiment, flaps, such as flaps 156, 158 extend downward from the outer edges of the top section 150 along each edge. The flaps may be provided to enhance isolation of the antenna element 148. For example, the flaps 156, 158 may serve to shape the field contained in the antenna element 148.

Figure 7A:
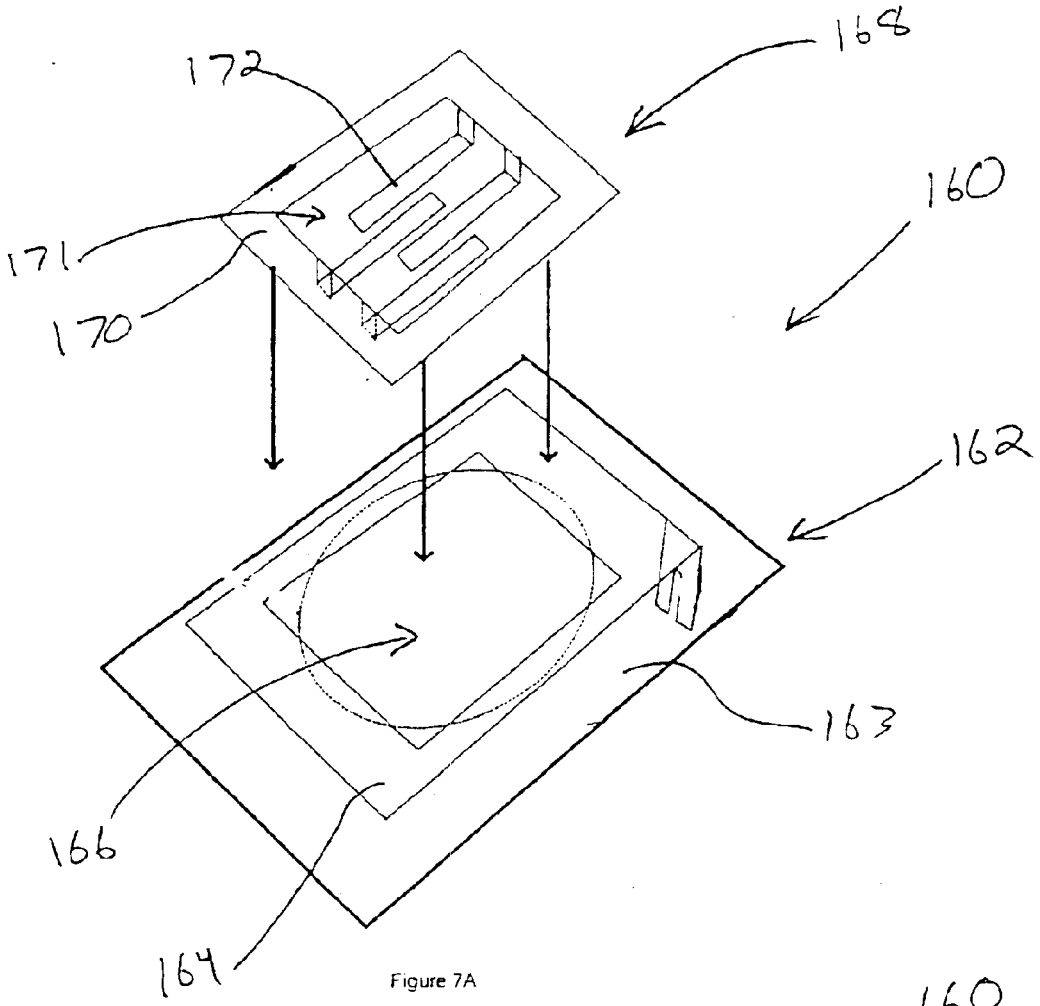
FIG. 7A illustrates a three-dimensional view of an embodiment of an antenna element assembly in accordance with the present invention.
Figure 7B:
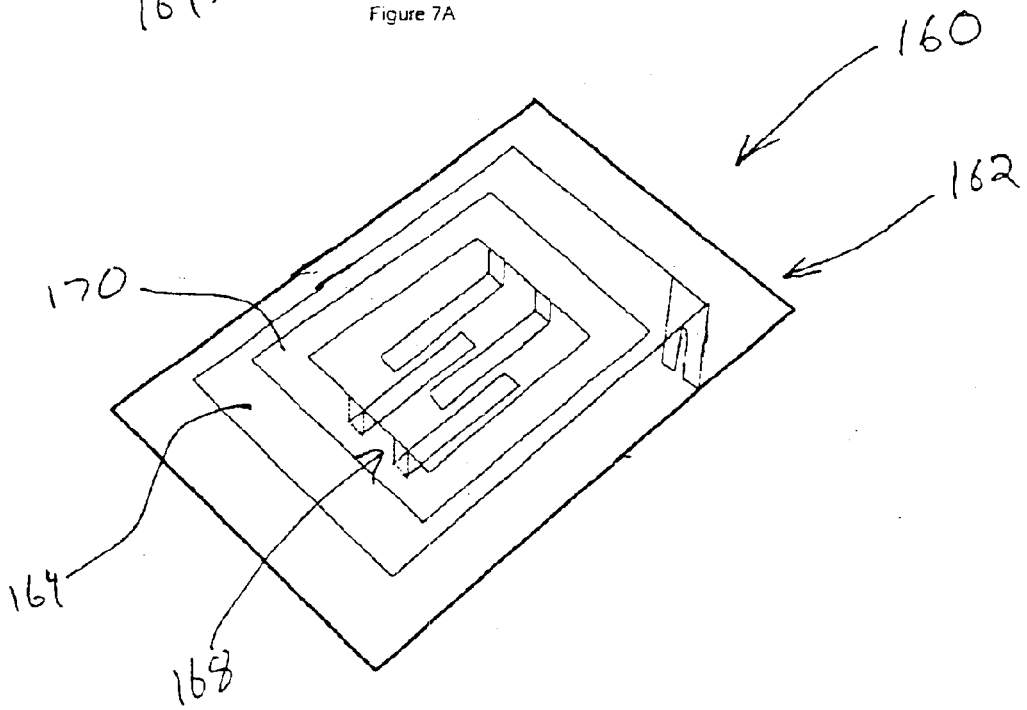
FIG. 7B illustrates a three-dimensional view of the antenna element assembly of FIG. 7A in a completely assembled configuration.

FIGS. 7A and 7B illustrate an embodiment of an antenna element assembly in accordance with the present invention. The antenna element assembly 160 includes a base section 162 having a bottom plate 163 and a top section 164. In other embodiments, the base section may be constructed in accordance with the antenna element described above with reference to FIG. 6. Referring again to FIGS. 7A and 7B, the top section 164 is provided with a module-receiving opening 166 in a central region of the top section 164. The module-receiving opening 166 of the embodiment illustrated in FIGS. 7A and 78 has a rectangular configuration. However, other configurations will be apparent to those skilled in the art.

A separate tongue module 168 is sized to be accommodated by the module-receiving opening 166 of the top section 164 of the base section 162. The tongue module 168 is provided with a top surface 170 having a central cutout 171. One or more tongues, such as tongue 172, may be provided within the cutout 171, in a manner similar to that described above.

FIG. 7B illustrates the antenna element assembly in an assembled configuration. In the illustrated embodiment, the top surface 170 of the tongue module 168 is substantially flush with the top section 164 of the base section. The tongue module 168 may be secured to the base assembly in any of a variety of well-known ways.

Although the embodiment illustrated in FIGS. 7A and 7B includes a top section having a single module-receiving opening for receiving a single tongue module, other embodiments may be adapted to accommodate a plurality of tongue modules in each top section.

Figure 8A:
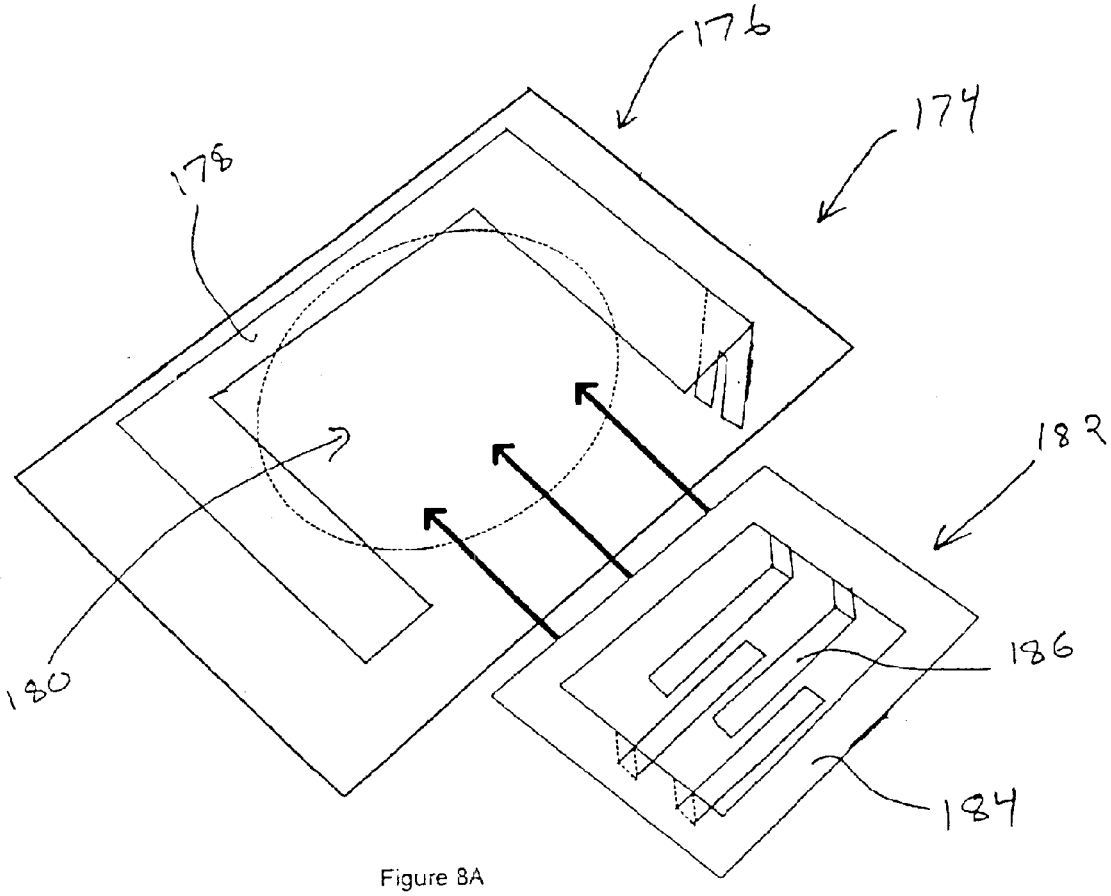
FIG. 8A illustrates a three-dimensional view of another embodiment of an antenna element assembly in accordance with the present invention.

FIG. 8A illustrates another embodiment of an antenna element assembly in accordance with the present invention. The antenna element assembly 174 includes a base section 176. The base section 176 includes a top section 178 having a module-receiving opening 180. Unlike the embodiment described above with reference to FIGS. 7A and 7B, the module-receiving opening 180 of the embodiment illustrated in FIG. 8A is surrounded by the top section 178 on three sides and is open on the fourth side, forming a U-shaped opening. A tongue module 182 may be inserted into the module-receiving opening 180 through the fourth side, as indicated by the dark arrows in FIG. 8A. The tongue module 182 illustrated in FIG. 8A includes a top surface 184, which may be substantially flush with the top section 178 when assembled, and one or more tongues, such as tongue 186.

Figure 8B:
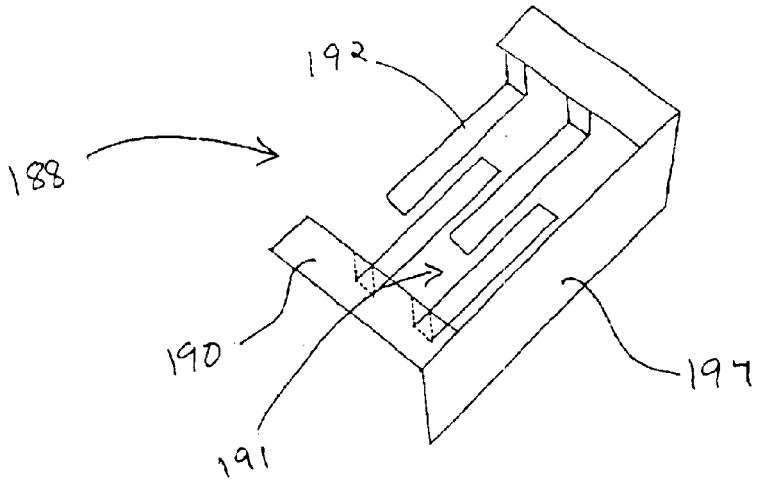
FIG. 8B illustrates a three-dimensional view of one embodiment of an assembly module for use with the antenna element assembly of FIG. 8A.

FIG. 8B illustrates another embodiment of a tongue module for use with the base section 176 illustrated in FIG.

8A. The tongue module 188 illustrated in FIG. 8B includes a top surface 190 having a cutout 192. One or more tongues, such as tongue 192, maybe provided within the cutout 192. The embodiment of FIG. 85 further includes a downward-extending flap 194 on one edge of the top surface 190. The flap 194 may facilitate isolation of the antenna element, as described above with reference to FIG. 6.

Figure 9:
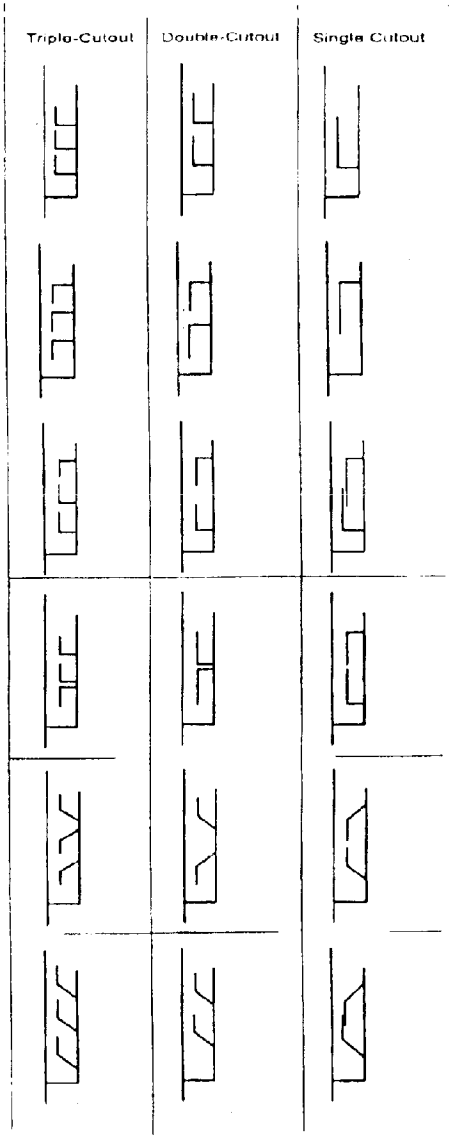
FIG. 9 is a chart illustrating side-views of various embodiments of an antenna element in accordance with the present invention.

FIG. 9 illustrates side-views of various embodiments of antenna elements in accordance with the present invention. As illustrated by the various embodiments shown in FIG. 9, any number of combinations of tongues in any number of cutouts may be provided in an antenna element. The number of cutouts in a top section of an antenna element may be varied along with the number of tongues in each cutout. The positioning of each tongue may also be varied to produce the desired antenna element characteristics.

While particular embodiments of the present invention have been disclosed, it is to be understood that various different modifications and combinations are possible and are contemplated within the true spirit and scope of the appended claims. There is no intention, therefore, of limitations to the exact abstract or disclosure herein presented.

We claim:

1. An antenna element, comprising:

a bottom plate;

a top section positioned above the bottom plate and having at least one cutout therein, the top section being positioned substantially parallel to the bottom plate; and one or more tongues extending from an edge of the at least one cutout, the one or more tongues being positioned below a plane of the top section, the one or more tongues including a vertical extension connecting a horizontal tongue portion to the top section.

2. An antenna element according to claim 1, wherein the vertical extension is substantially perpendicular to the top section.

3. The antenna element according to claim 1, wherein each cutout has a substantially rectangular configuration.

4. The antenna element according to claim 1, wherein the top section includes a single cutout.

5. The antenna element according to claim 4, wherein the single cutout is provided with a single tongue.

6. The antenna element according to claim 4, wherein the single cutout is provided with a plurality of tongues.

7. The antenna element according to claim 6, wherein each of the plurality of tongues extends from the same edge of the cutout.

8. The antenna element according to claim 6, wherein the plurality of tongues includes tongues extending from the different edges of the cutout.

9. An antenna element assembly, comprising:

a base section having a bottom plate and a top section positioned above the bottom plate, the top section having a module-receiving opening therein; and a tongue module adapted to be accommodated within the module-receiving opening, the tongue module comprising:

a top surface with at least one cutout therein; and one of more tongues extending from an edge of the at least one cutout.

10. The antenna element assembly according to claim 9, wherein the module-receiving opening is substantially rectangular and is located in a central region of the top section.

11. The antenna element assembly according to claim 9, wherein the cutout is substantially rectangular.

12. The antenna element assembly according to claim 9, wherein the module-receiving opening is U-shaped.

13. The antenna element assembly according to claim 12, wherein the tongue module includes a vertical flap extending downward from an edge of the top surface.

* * * * *